United States Patent [19]

Okado et al.

[11] Patent Number: 4,506,243

[45] Date of Patent: Mar. 19, 1985

[54] ELECTROMAGNETIC CONTACTOR

[75] Inventors: Hiroyuki Okado, Owariasahi; Masahiro Kakizoe, Kuwana; Shigeharu Otsuka, Gifu; Yuji Sako, Nagoya, all of Japan

[73] Assignee: Mitsubishi Denki Kabushiki Kaisha, Tokyo, Japan

[21] Appl. No.: 381,728

[22] Filed: May 24, 1982

[30] Foreign Application Priority Data

| | | | |
|---|---|---|---|
| May 28, 1981 | [JP] | Japan | 56-81448 |
| Aug. 4, 1981 | [JP] | Japan | 56-122110 |
| Aug. 4, 1981 | [JP] | Japan | 56-122111 |

[51] Int. Cl.[3] ..... H01H 50/04

[52] U.S. Cl. ..... 335/132; 335/202

[58] Field of Search ..... 335/132, 131, 133, 202

[56] References Cited

U.S. PATENT DOCUMENTS

| | | | |
|---|---|---|---|
| 2,556,716 | 6/1951 | Viol | 335/132 |
| 3,178,534 | 4/1965 | Bundy et al. | 335/132 |
| 3,251,964 | 5/1966 | Lawrence et al. | 335/132 |
| 4,253,076 | 2/1981 | Guery et al. | 335/132 |

*Primary Examiner*—E. A. Goldberg
*Assistant Examiner*—George Andrews
*Attorney, Agent, or Firm*—Wenderoth, Lind & Ponack

[57] ABSTRACT

The disclosed electromagnetic contactor has a base including a lateral opening and an internal space, and two rails disposed at the bottom of the internal space. A U-shaped stationary iron core including two guides on both sides is assembled into a coil holder so that one leg of the "U" is surrounded by an operating coil held by the coil holder. Then the coil holder is inserted into the internal space in the base through the lateral opening with the guides engaging the rails until it is removably positioned in the internal space.

8 Claims, 10 Drawing Figures

ELECTROMAGNETIC CONTACTOR

BACKGROUND OF THE INVENTION

This invention relates to improvements in an electromagnetic contactor.

A conventional electromagnetic contactor has an electrically insulating base fixed to a box-shaped mounting plate by a plurality of fastening screws, a stationary iron core disposed on the mounting plate, an operating coil disposed around the stationary iron core and connected via a lead to a coil terminal disposed on the base, a movable iron core disposed on a movable cross bar opposed to the stationary iron core with a predetermined gap therebetween, a spring loaded movable contact arm and bearing a movable contact, and a stationary contact arm disposed on the base and connected to a circuit terminal disposed on the base adjacent thereto, and the stationary contact arm bearing a stationary contact opposed to the movable contact with a predetermined gap therebetween which is smaller than the gap between the stationary and movable iron cores.

In conventional electromagnetic contactors such as described above, it is required to remove the operating coil held by the coil holder from the particular electromagnetic contactor to inspect the coil for purposes of maintenance or to exchange the coil for a new one. To this end, the fastening screws must be unscrewed to separate the base from the mounting plate followed by the disengagement of the coil terminal from the lead to the operating coil. This has resulted in a complicated removing operation. With the circuit terminal connected to a lead to an associated circuit, it is required to remove that lead from the circuit terminal resulting in a more complicated removing operation.

Accordingly, it is an object of the present invention to provide a new and improved electromagnetic contactor including means for easily removing a coil holder with an operating coil held thereby from the electromagnetic contactor.

SUMMARY OF THE INVENTION

The present invention provides an electromagnetic contactor for closing and opening an electric circuit, a pair of movable and stationary contacts disposed opposite to each other, a movable iron core connected to the movable contact to move the movable contact, a stationary iron core disposed opposite to the movable iron core, an operating coil disposed around the stationary iron core, the stationary iron core driving the movable iron core toward the core in response to the energization of the operating coil, a base including an internal space for accommodating the stationary iron core and the operating coil therein, and a lateral opening communicating with the internal space, rail means disposed at the bottom of the internal space in the base, and a coil holder including a rail engaging member for engaging the rail means, the coil holder holding the operating coil and having the stationary iron core assembled thereinto, the coil holder being inserted into and fixed in the internal space in the base through the lateral opening while engaging the rail means, with the operating coil and stationary iron core disposed on the coil holder.

In order to prevent the stationary iron core from dropping out of the coil holder when inserting the coil holder with the stationary iron core into the base, an engaging hole may be disposed in a guide attached to each side of the stationary iron core and engaged by an engaging piece disposed on the coil holder.

In order to decrease the slide resistance developed when the stationary iron core is inserted into the base, the guide may be partly formed of a resilient material to flexibly connect the stationary iron core to the coil holder.

BRIEF DESCRIPTION OF THE DRAWINGS

The present invention will become more readily apparent from the following detailed description taken in conjunction with the accompanying drawings in which.

Throughout the Figures like reference numerals designate identical or corresponding components.

DESCRIPTION OF THE PREFERRED EMBODIMENTS

Figure 1:
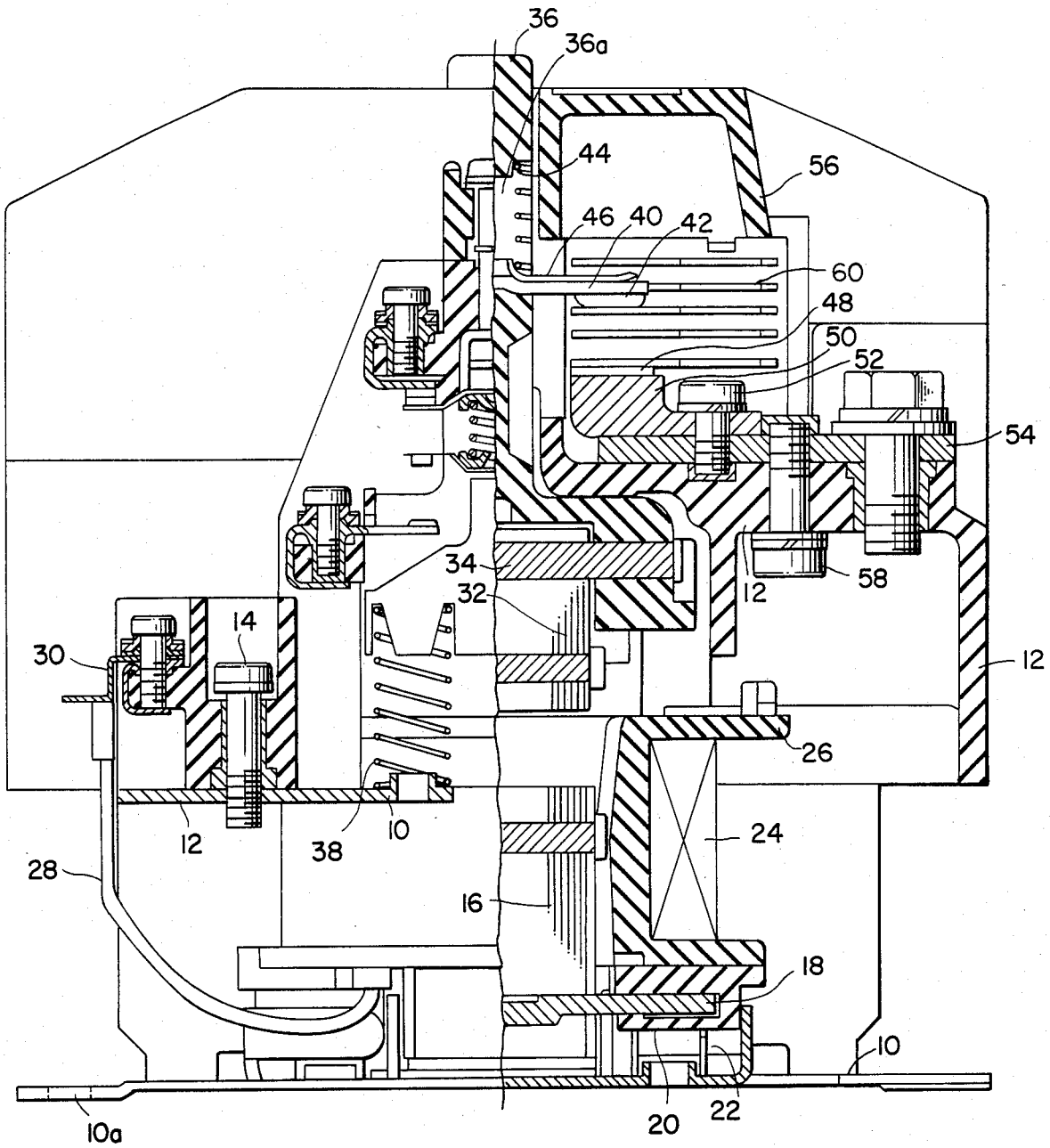
FIG. 1. PRIOR ART
FIG. 1 is an elevational sectional view of a conventional electromagnetic contactor, with parts illustrated in elevation.

Referring now to FIG. 1 of the drawings, there is illustrated a conventional electromagnetic contactor. The arrangement illustrated comprises a mounting plate 10 formed into a box and provided with a plurality of mounting holes 10*a* for mounting the main body of the electromagnetic contactor on a control board although only one of the mounting holes 10*a* is shown only for purposes of illustration. Then a base 12 formed of an electrically insulating material is fixedly secured to the mounting plate 10 by a plurality of fastening screws 14 only one of which is shown only for purposes of illustration and a stationary iron core 16 formed of a stack of U-shaped silicon steel laminations is disposed at the bottom of the mounting plate 10 by having a pair of pins 18 extending therethrough with a rubber buffer 20 and a buffer spring 22 interposed between each of the protruding end portions of each pin 18 and the mounting plate 10. An operating coil 24 is held by a coil holder 26 in the form of a reel and is disposed around a substantial part of the stationary iron core 16 and is connected via lead 28 to a coil terminal 30 disposed on the base 12.

A movable iron core 32 formed also of a stack of silicon steel laminations 16 is disposed opposite to the stationary iron core 16 with a predetermined gap therebetween and connected through a pin 34 to a lower end of an electrically insulating cross bar 36. The cross bar 36 is movable lengthwise thereof and tends normally to be moved in an upward direction as viewed in FIG. 1 by the action of a trip spring 38 disposed between the lower end of the cross bar 36 and the adjacent portion of the mounting plate 10.

A movable contact arm 40 carrying a movable contact 42 is fixedly inserted into a holding hole 36*a* in the cross bar 36 to extends substantially perpendicular to the longitudinal axis of the cross bar 36 and has a pressure applied thereto by means of a contact spring 44 supported by a spring retainer 46 disposed on the movable contact arm 40. A stationary contact 48 is normally disposed in opposed relationship to the movable contact 42 with predetermined gap therebetween. A stationary contact arm 50 has the contact 48 at one end thereof and the other end is secured by a fastening screw 52 to a circuit terminal 54 disposed on the adjacent portion of the base 12 to be connected to an associated circuit (not shown) therethrough.

Further an arc box 56 of a heat resisting electrically insulating material is fixedly secured to the base 12 by a plurality of fastening screws 58 and includes a plurality of grids 60 formed of a magnetic metallic material and disposed in spaced parallel relationship therein to surround the movable and stationary contacts 42 and 48 respectively.

In operation the operating coil 24 is supplied with a driving voltage to generate an electromagnetic attraction between the stationary and movable iron cores 16 and 32 respectively by the action of a flux generated by the operating coil 24 thereby to attract the movable iron core 32 to the stationary iron core 16 against the action of the trip spring 38. This causes movement of the cross bar 36 connected to the movable iron core 32 toward the stationary iron core 16. Thus the movable contact 42 on the movable contact arm 40 held by the cross bar 36 abuts the stationary contact 48 on the stationary contact arm 50. It is noted that the gap between the movable and stationary iron cores 16 and 32 respectively is preliminarily formed to be larger than that between the movable and stationary contacts 42 and 48 respectively. Therefore when the two iron cores abutting against each other, the cross bar 36 is further moved toward the stationary iron core 16 beyond its position corresponding to a position where the two contacts engage each other. Thus the contact spring 44 is compressed and transmits the resulting spring pressure to the movable contact arm 40 through the spring retainer 46. As a result, the movable contact 42 is brought into its closed position under a predetermined contact pressure. Thus the associated circuit is closed.

Upon the cessation of the driving voltage in the operating coil 24, the electromagnetic attraction developed between the stationay and movable iron cores 16 and 32 is ended and the cross bar 36 is moved away from the stationary iron core 16 by the action of the compressed trip spring 38. Thus the movable contact 56 is separated from the stationary contact 48.

At that time an electric arc is produced across the movable and stationary contacts 42 and 48 respectively. However the electric arc is pulled toward the grids 60 surrounding those contacts so as to be cooled and divided into small portions. Therefore the electric arc is extinguished to open the associated circuit.

In the arrangement of FIG. 1 it is required to remove the operating coil 24 held by the coil holder 26 from the arrangement in order to inspect the coil 24 for purposes of maintenance or to exchange the coil 24 for a new one because of a variation in driving voltage applied thereacross. The operation of removing operating coil 24 from the arrangement of FIG. 1 has comprised the steps of unscrewing the fastening screws 14 to separate the base 12 from the mounting plate 10 and removing the lead 28 from the coil terminal 30. When the removing operation is performed after the entire electromagnetic contactor has been installed and the circuit terminal 54 has been connected to the associated circuit, it has been also required to disconnect that terminal from a lead connected to the associated circuit and detach the contactor from the predetermined position followed by the separation of the mounting plate from the base and the removal of the operating coil.

In other words, the arrangement of FIG. 1 has been disadvantageous in that the operating coil 24 can be removed therefrom only by extremely complicated steps.

The present invention seeks to eliminate the disadvantage of the prior art practice by the provision of means for easily removing the coil holder with both an operating coil held thereby and a stationary iron core from their installed position.

Referring now to FIGS. 2 through 5, there is illustrated one embodiment of the electromagnetic contactor according to the present invention.

Figure 2:
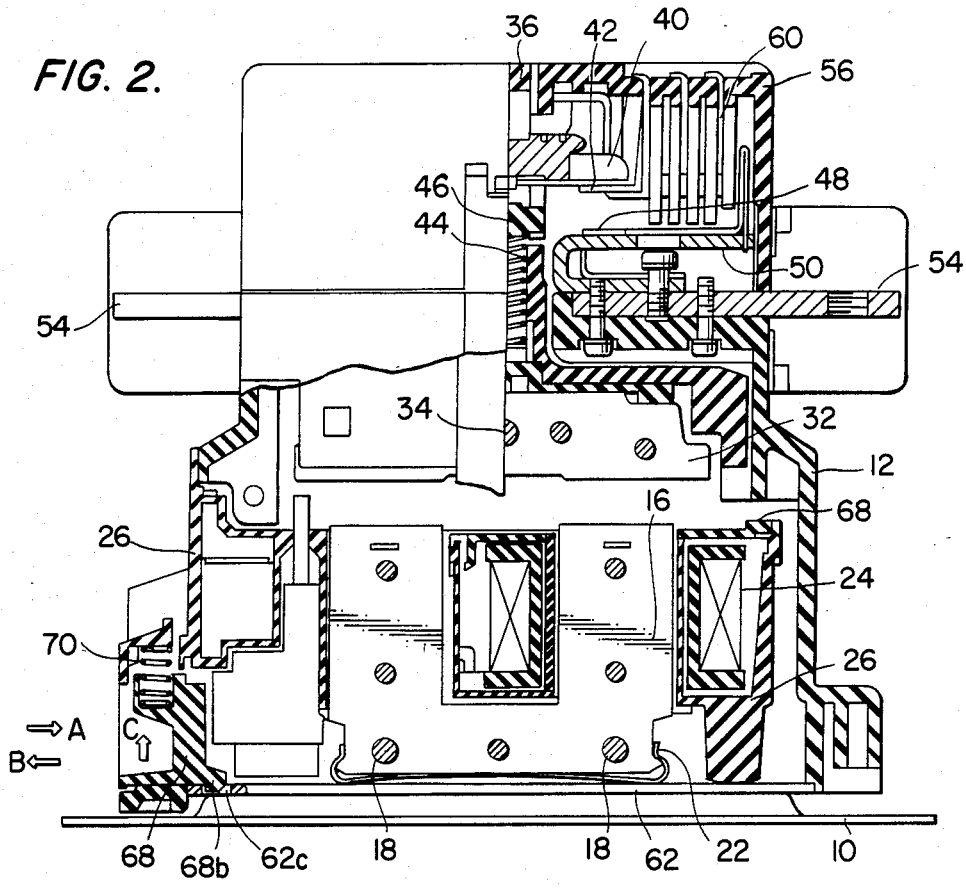
FIG. 2 is an elevational sectional view of one embodiment of the electromagnetic contactor of the present invention with parts illustrated in elevation.

As shown in FIG. 2, the arrangement illustrated comprises a rail member 62, in this case, a rail plate disposed on the mounting plate 10 and the base 12 disposed on the rail plate 62.

Figure 4:
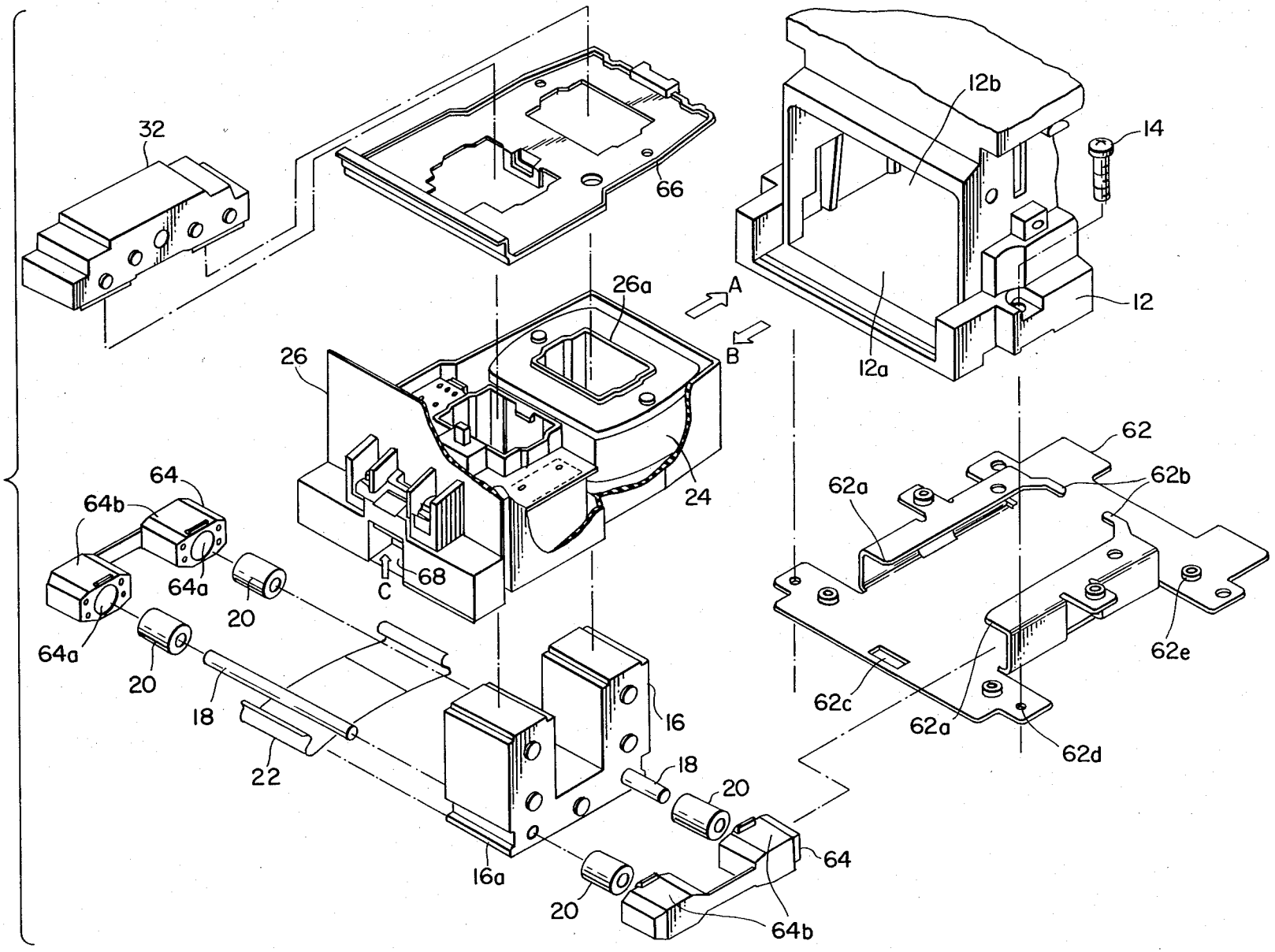
FIG. 4 is an exploded perspective view of the driving unit for operating the movable iron core as shown in FIGS. 2 and 3.

Referring to FIG. 4, the rail plate 62 is substantially rectangular and has a pair of longer opposite sides having a pair of opposite parallel rails 62*a* formed by cutting each of those sides at two positions, raising that portion thereof located between the two position and folding the raised portion internally. The rail plate 62 further includes a pair of stops 62*b* disposed at those ends of the rails 62*a* remote from the viewer and opposed to each other, an engaging hole 62*c* centrally disposed on that side of the rail plate 62 remote from the stops 62*b*, a pair of mounting holes 62*d* disposed on opposte sides of the rail plate 62 adjacent to the other ends of the rails 62*a* for mounting the rail plate 62 on the mounting plate 10, and another pair of mounting holes 62*e* disposed on opposite sides of the rail plate 62 adjacent to the remote ends of the rails 62*a* for purpose of mounting the base 12 on the rail plate 62.

The base 62 is formed of an electrically insulating material and the details thereof are shown in FIG. 4. As shown, the base 12 includes a bottom having an opening 12*a* into which the rails 62*a* on the rail plate 12 can extend and one lateral side having a lateral opening 12*b* permitting the operation coil holder, as will be described later, to be inserted into and removed from the base 12 which has an internal space sufficient to accommodate the two therein.

The stationary iron core 16 is formed of a rivetted stack of U-shaped silicon steel laminations and a pair of pins 18 fixedly extending therethrough with both end portions protruding beyond the associated sides of the iron core 16. Those protruding end portions of each pin 18 are surrounded by respective rubber buffers 20 each fitted into an associated one of recesses 64*a* in a pair of guides 64. A buffer spring 22 in the form of a leaf spring is carried by the stationary iron core 16 by having both ends engaging respective grooves 16*a* in the lower portions of the legs of the "U" shaped core 16. The buffer spring 22 functions to decrease shocks developed when an operating coil assembly, as will be described later, is inserted into and removed from the base 12 and when the electromagnetic contactor is brought into its closed position.

The guide 64 includes a pair of rail pegs 64*b* at both ends adapted to engage the rails 62*a* on the rail plate 62 respectively.

The operating coil 24 is disposed within the coil holder 26 so that it fits into one of a pair of hollow cylinders extending from the bottom of coil holder 26 to define a pair of through holes 26*a* complementary in cross section to the legs of the U-shaped stationary iron core 16 and adapted to permit those legs to be fitted thereinto. Those hollow cylinders are enclosed within a peripheral wall of the coil holder 26 with space therebetween. That portion of the peripheral wall remote from the operating coil 24 is closed with a lateral cover 26*b* larger in height than the peripheral wall. Then the opening between the peripheral wall and the coil holder is closed with a cover 66 substantially identical in shape to that opening and including a pair of holes aligned with the through holes 26*a* in its closed position.

The lateral cover 26*b* serves to prevent dust and other foreign matter from entering the base when the coil holder 26 with the stationary iron core 16 is inserted into the base 12.

Figure 5:
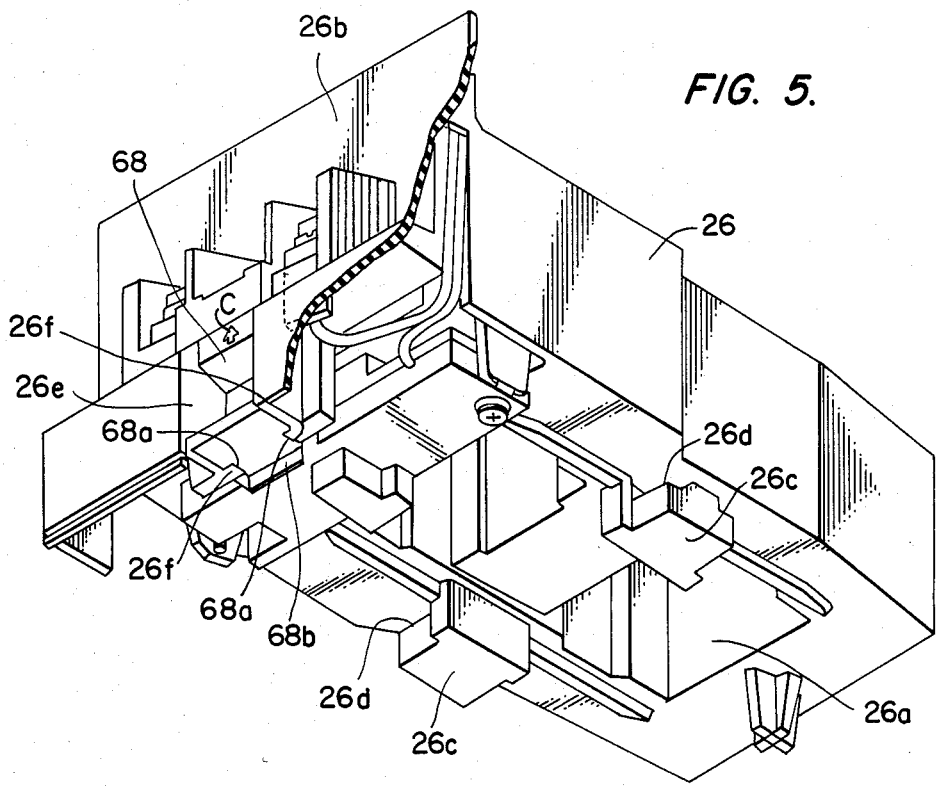
FIG. 5 is a perspective view of the coil holder shown in FIG. 2 as viewed from the bottom thereof.

As shown in FIG. 5, the coil holder 26 is further provided on the bottom with a pair of opposite rail engaging portions 26*c* with gaps 26*d* between the same and the main body of the coil holder 26 and a pair of opposed latch holding portions 26*e* including a pair of protrusions 26*f* positioned to engage a latch 68. More specifically, the latch 68 includes a pair of recesses 68*a* arranged to slidably engage the protrusions 26*f* in the direction of the arrow C shown in FIG. 5 and an engaging protrusion 68*b*. Upon the assembly of the contactor that protrusion 68*b* is positioned to engage in the engaging hole 62*c* in the rail plate 62. As shown in FIG. 2, the latch 68 is forced downwardly by a return spring 70 when the latch is positioned in the latch holding portions 26*e*.

The components as described above and particularly the coil holder 26 and those components operatively coupled thereto are assembled into a unitary structure according to the following program: First the pair of pins 18 are passed through the stationary iron core 16 and the two end portions thereof protruding beyond the stationary iron core 16 are fixedly surrounded by the rubber buffers 20 which are, in turn, fitted into the associated recesses 64*a* in the guides 64. At the same time, the stationary iron core 16 with the buffer spring 22 is inserted into the holes 26*a* in the coil holder 26 from the bottom thereof whereby the stationary iron core 16 with the buffer spring 22 and the guides 64 is mounted on with the coil holder 26 including the operating coil 24.

At that time the legs of the "U" shaped core 16 have the free end portions somewhat protruding from the cover 66 as shown in FIG. 2. This structure will be called hereinafter an operating coil assembly.

On the other hand, the rail plate 62 is fixed to the base 12 by the fastening screws 14 so that the rails 62*a* extend into the internal space of the base 12 through the opening 12*a* in the bottom thereof. Then the rail plate 62 is disposed on the mounting plate 10 so that the lateral opening 12*b* opens into the side as viewed in FIG. 2 of the main body of the electromagnetic contactor on which circuit terminals 54 for an associated circuit are disposed.

Then the coil holder 26 having the operating coil 24 assembled thereinto is inserted into the lateral opening 12*b* on the base 12 in the direction of the arrow A shown in FIGS. 2 and 4 through the lateral opening 12*b* on the base 12 so that the gaps 26*d* fit around the rails 62*a* on the rail plate 62 respectively until the stops 62*b* have the adjacent portions of the operating coil assembly abutting against the same respectively. At that time the movement of the coil holder 26 in the direction of the arrow A is stopped and the latch 68 on the coil holder 26 has the engaging protrusion 68*b* engaging the engaging in hole 62*c* in the rail plate 62 to prevent the coil holder 26 from being moved in the direction of the arrows A and the direction opposite thereto as shown by the arrow B in FIG. 2 or 4. That is, the coil holder 26 or the operating coil assembly is put in its locked state.

Further each of the guides 64 is sandwiched between the associated rail 62*a* and that portion of the rail plate 62 disposed directly below the rail 62*a* whereby the stationary iron core 16 is prevented from being moved in either the upward or downward directions as viewed in FIG. 2. In addition the stationary iron core 16 tends to be moved in the upward direction as viewed in FIG. 2 by the action of the buffer spring 22 with the result that the upward movement of the stationary iron core 16 is more firmly prevented.

From the foregoing it is seen that the coil holder 26 with the stationary iron core 16 mounted thereon is disposed at a predetermined position on the base 12 only through its movement along the rails 62*a* on the rail plate 62 and still can be strongly fixed at that predetermined position.

Figure 3:
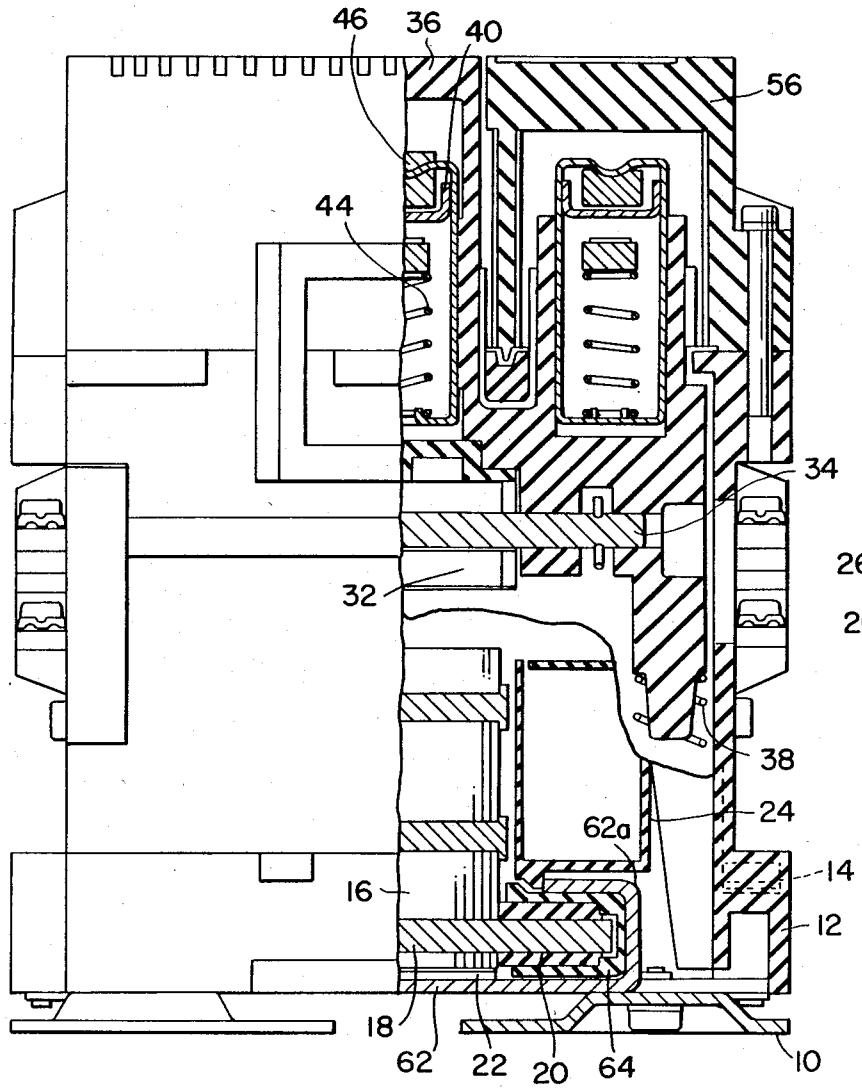
FIG. 3 is a elevational sectional view of the arrangement shown in FIG. 2 with one half thereof illustrated in side elevation.

This results in the arrangement shown in FIGS. 2 and 3.

As in the arrangement of FIG. 1, the movable iron core 32 is located above the stationary iron core 16 held by the coil holder 26 fixed at its predetermined position with a predetermined gap therebetween and the side cover 26*b* completely closes the lateral opening 12*b* in the base to form a part of a housing for the arrangement.

In order to remove the coil holder 26 with the stationary iron core 16 and the operating coil 24 from the base 12, the latch 68 is first raised in the direction of the arrow C shown in FIGS. 2, 4 or 5 against the action of the return spring 70 to disengage the engaging protrusion 68*b* thereof from the engaging hole 62*c* in the rail plate 62. With the latch 68 in that condition, the coil holder 26 is drawn out in the direction of the arrow B resulting in the removal of the coil holder 26 from the base 12.

With the electromagnetic contactor installed on an associated control board, each of the assembling and removing operations as described above can be repeated while the contactor is left in place.

In other respects the arrangement illustrated in FIGS. 2 and 3 is substantially identical to that shown in FIG. 1.

FIGS. 6, 7, 8 and 9 show a modification of the present invention. The arrangement illustrated is different from that shown in FIGS. 2, 3, 4 and 5 in that in FIGS. 6, 7 and 8 there are provided means for ensuring the connection of the stationary iron core 16 to the coil holder 26 upon inserting and rmoving the coil holder 26 with the stationary iron core 16 into and out of the base 12 and means for accurately positioning the coil holder 26 with the stationary iron core 16 on the base 12.

Figure 6:
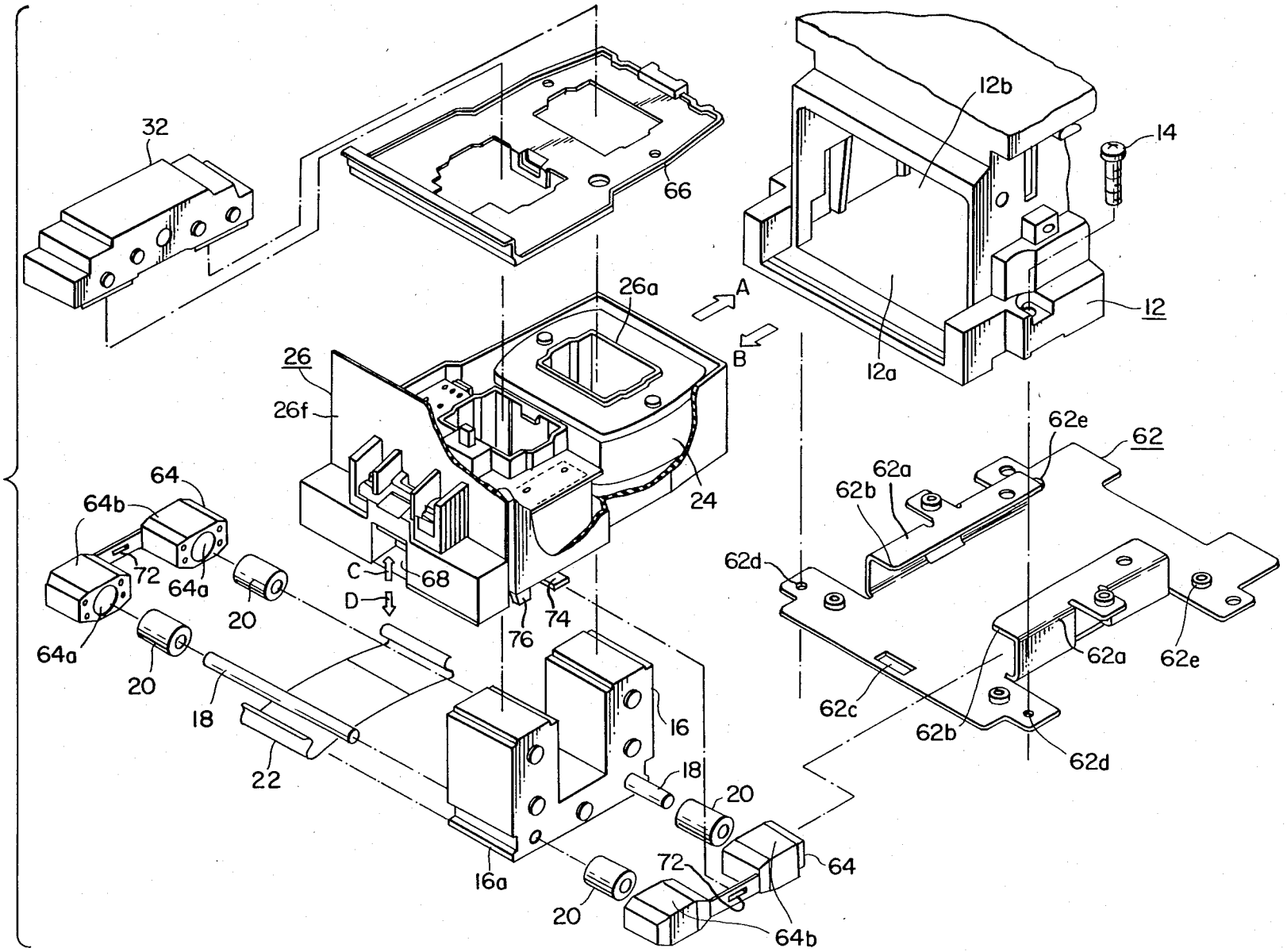
FIG. 6 is a view similar to FIG. 4 but illustrating a modification of the present invention.

To this end, the guide 64 is provided with a central engaging hole 72 as shown in FIG. 6 and the coil holder 26 includes a pair of L-shaped engaging pieces 74 disposed in opposed relationship at the bottom thereof at positions where those L-shaped pieces can engage in the engaging holes 72 on the guides 64 respectively, when the stationary iron core 16 is disposed in place within the coil holder 26. The L-shaped engaging pieces 74 are shown best in FIG. 7 and each is engaged in the engaging hole 72 in the associated guide 64 by moving the latter toward the coil holder 26 in the direction of the arrow shown in FIG. 8. This movement of each guide 64 is preferably effected after the stationary iron core 16 with the rubber buffers 20 has been assembled into the coil holder 26.

This engagement of the L-shaped pieces 74 in the respective engaging holes in the guides 64 ensures that the operating coil assembly can be inserted into and removed from the base 12 and the stationary iron core 16 is prevented from dropping out of the coil holder 26.

Figure 7:
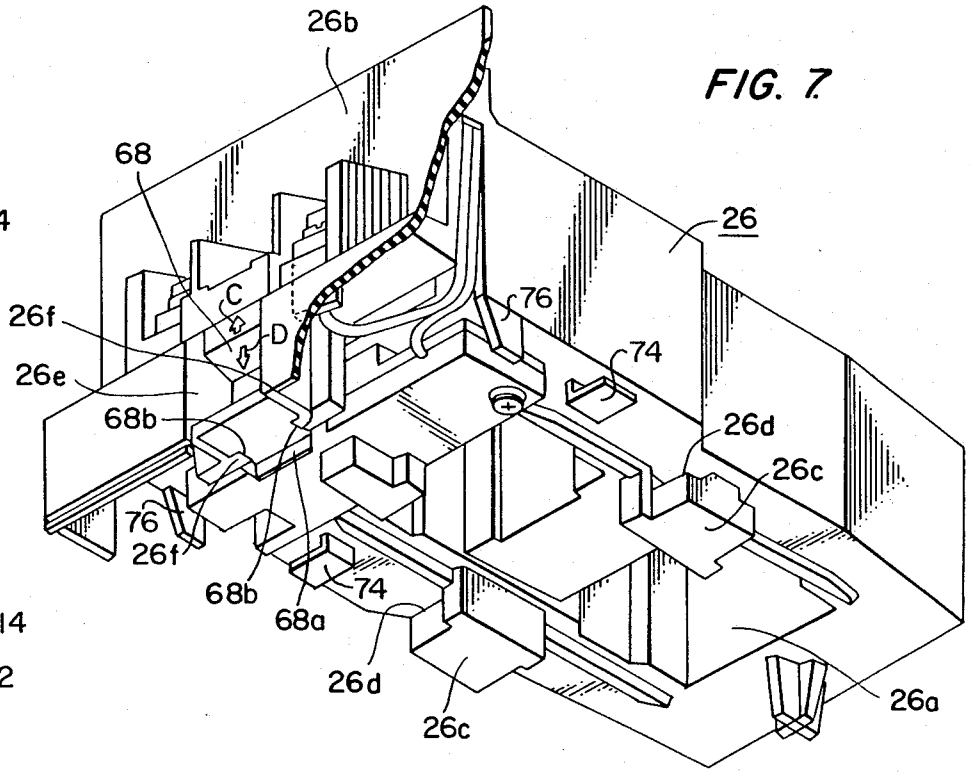
FIG. 7 is a view similar to FIG. 5 but illustrating the coil holder shown in FIG. 6.

As shown best in FIG. 7, a pair of stops 76 are disposed on opposite sides of the bottom of the coil holder 26 adjacent to the L-shaped engaging pieces respectively.

Also as shown in FIG. 6, the rail plate 62 includes a pair of stops **62'*b* disposed at those ends of the parallel rails 62*a* near to the engaging hole 62*c* which is opposite to the stops 62*b* shown in FIG. 2**.

The stops 76 on the coil holder 26 are arranged to abut against the stops **62'*b* on the rail plate 62**.

The components shown in FIG. 6 are assembled into a unitary structure by repeating the process as described above in conjunction with FIG. 4.

This results in the arrangement shown FIG. 9 which is identical to that illustrated in FIGS. 2 and 3 except in the following respects: The L-shaped engaging pieces 74 on the coil holder 26 in the associated engaging holes 72 in the guides 64 ensuring the engagement of the the stationary iron core 16 with the coil holder 26. Thus the stationary iron core 16 is prevented from dropping out of the coil holder 26. The arrangement shown in FIG. 9 includes source terminals for an associated circuit mounted to the left of the main body thereof as described above and an overcurrent relay is normally mounted to the right thereof. Further other electric devices are normally mounted in the vicinity of the lateral walls of the base 12 except for the lateral wall including the source terminal. Thus the wall including the source terminal does not face the other electric devices. Therefore there is no fear that the stationary iron core will break or the operator will be injured due to the dropping of the same. Also the stops 76 on the coil holder 26 abut against the stops **62'*b* on the rail plate 62 to accurately position and fix the coil holder 26 on the base 12 in the direction in which the coil holder 26 is inserted into the base 12**.

Also after the main body of the electromagnetic contactor has been installed in place, the operating coil, the stationary iron core etc. can readily be mounted on and removed from the main body by inserting and removing the operating coil assembly into and from the base 12 having the source terminals disposed thereon, and without any disturbance due to those surrounding components. Also when the operating coil assembly is mounted on the base 12, the stationary iron core 16 is horizontally engaged by the coil holder 26. Thus it can be reinforced to hold the stationary iron core 16 by the coil holder 26.

The foregoing is true in the case of the arrangement shown in FIGS. 2 and 3.

Figure 9:
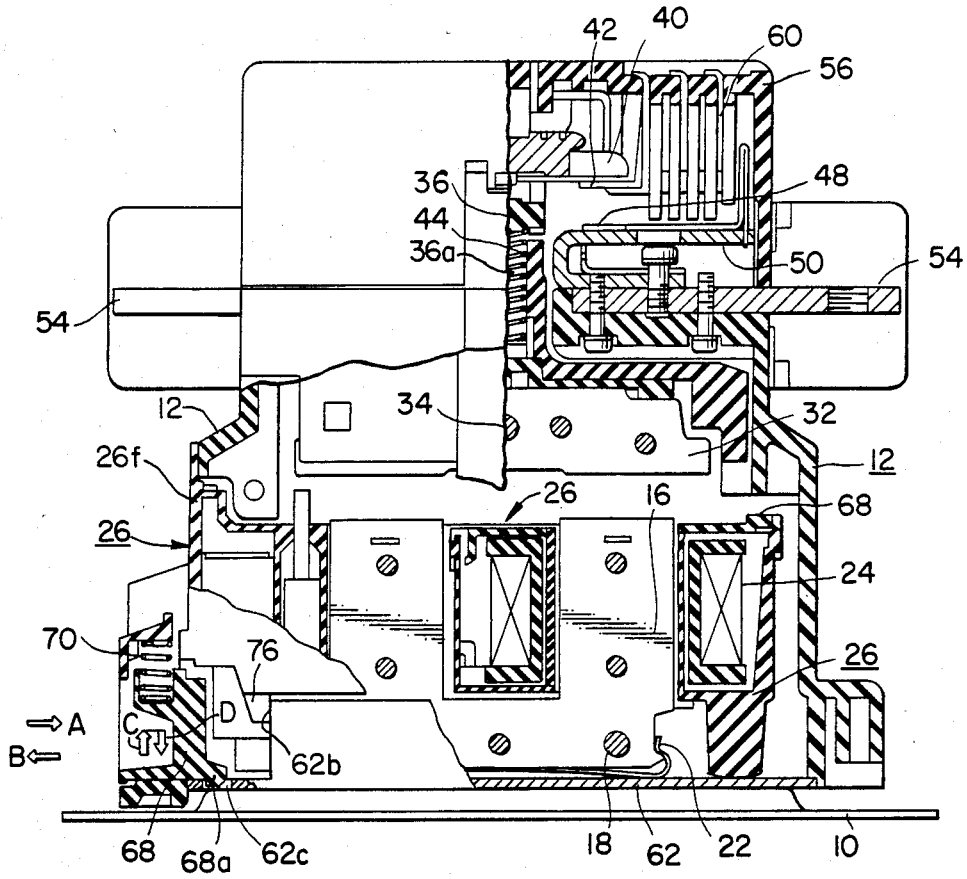
FIG. 9 is a view similar to FIG. 2 but illustrating a modification of the present invention, including the components shown in FIGS. 6, 7 and 8.

Further in the arrangement of FIG. 9, the operating coil assembly is accurately positioned on the base 12 by the engagement of the stops 76 on the coil holder 26 with the stops **62'*b* on the rail plate 62 as described above. Thus the operating coil assembly can be positioned on and fixed to the base 12 in a stabilized manner. This permits the spacing between the lateral cover 26*b* of the coil holder 26 and the lateral opening 12*b* on the base 12** to be reduced thereby to prevent dust and other foreign matter from entering the main body.

Figure 8:
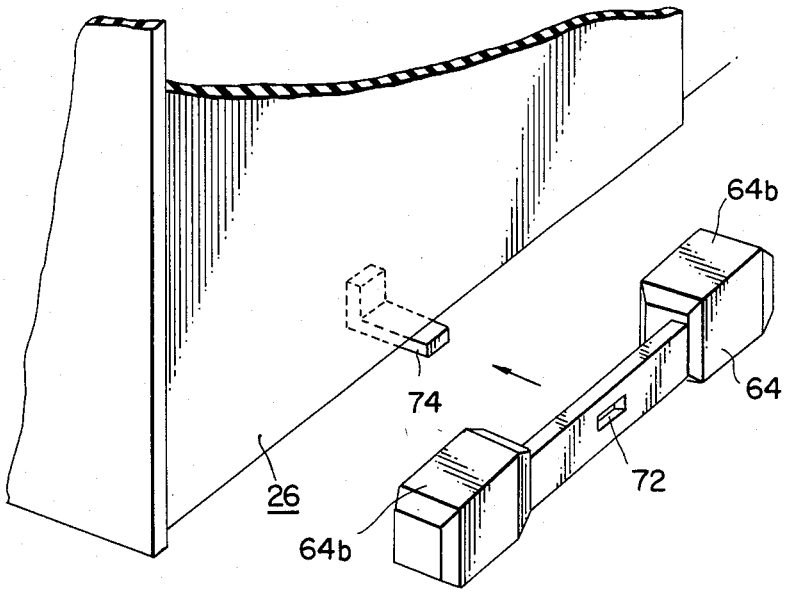
FIG. 8 is a fragmental exploded perspective view of the coil holder and guide shown in FIG. 6.
Figure 10:
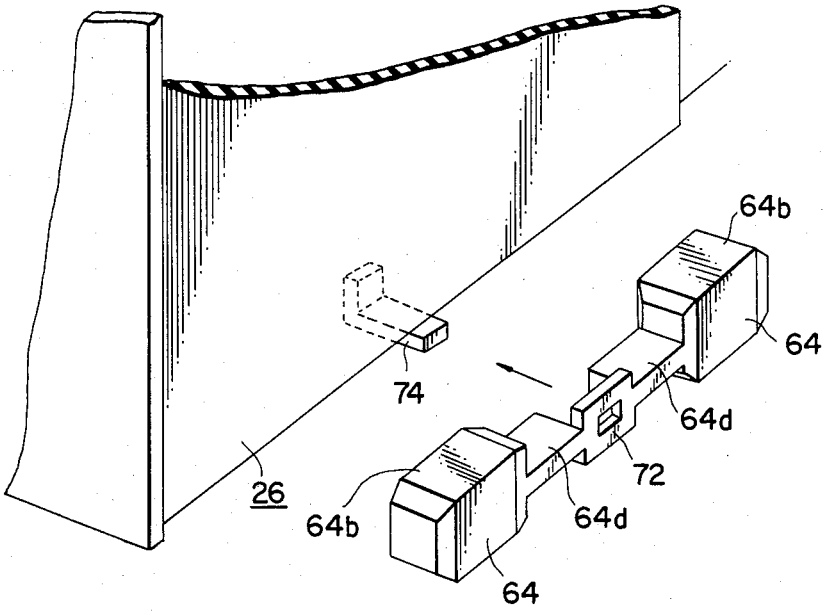
FIG. 10 is a view similar to FIG. 2 but illustrating a modification of the guide shown in FIG. 8.

FIG. 10 shows a modification of the guide 64 illustrated in FIG. 8. The arrangement illustrated is different from that shown in FIG. 8 only in that in FIG. 10 each of the rail pegs **64*b* is formed of a resilient material and connected to the central engaging hole 72 through a connecting rod 64*d* having a cross section in the form of a rectangle having a pair of longer sides extending in the direction in which the guide 64 is moved toward the coil holder 26 during the assembling. The connecting rods 64*d* are formed of the same material as the rail pegs 64*b***.

Thus the stationary iron core 16 is flexibly connected to the coil holder 26 during their assembling and resiliently held by the latter.

This reduces the sliding resistance developed during the insertion of the operating coil assembly into the base 12 due to the flexible connection of the stationary iron core 16 to the coil holder 26. Thus the operating coil assembly can be smoothly mounted on the base 12.

From the foregoing it is seen that, according to the present invention, the operating coil assembly including the coil holder, the operating coil and the stationary iron core is located and firmly fixed in a predetermined position on the base simply by inserting the operating coil assembly into the base along a rail plate.

While the present invention has been illustrated and described in conjunction with a few preferred embodiments thereof it is to be understood that numerous changes and modifications may be resorted to without departing from the spirit and scope of the present invention. For example, the L-shaped piece 74 and the engaging hole 72 may be disposed on the guide 64 and in the coil holder 26 respectively.

What we claim is:

1. An electromagnetic contactor for controlling the closing and opening of an electric circuit, comprising:

a movable contact and a stationary contact opposed to each other and said movable contact being movable toward and away from a position in which it contacts said stationary contact;

a movable iron core connected to said movable contact for moving said movable contact;

a stationary iron core opposed to said movable iron core for driving said movable iron core in the direction of movement of said movable contact;

an operating coil disposed around said stationary iron core;

a base having an internal space for accommodating said stationary iron core and said operating coil and having an opening in the lateral portion thereof;

a rail means disposed in the bottom of said internal space;

a coil holder including a rail means engaging member for engaging said rail means for guiding said coil holder into and out of said internal space, said coil holder having said stationary iron core and said operating coil assembled thereonto, said coil holder having a cover mounted thereon, said cover engaging said base and closing said lateral opening when said coil holder with said operating coil and said stationary iron core thereon are moved into said internal space along said rail means, and a latch mechanism disposed on the outside of said cover facing away from said base and movable on said cover toward and away from a portion of said base and movable into engagement with said base when said coil holder is moved into a predetermined position on said base and said cover closes said lateral opening to prevent said coil holder from unintentionally coming out of said base and being movable out of engagement with said base when said coil holder is to be removed from said base.

2. An electromagnetic contactor as claimed in claim 1 wherein said rail means comprises rails disposed on opposite sides of the bottom of said internal space and extending toward each other from the edges of said lateral opening, and said rail means engaging member comprises a member for engaging said rail means for guiding movement of said coil holder into and out of said internal space and preventing said coil holder from being moved in a direction perpendicular to the direction of movement thereof along said rail means.

3. An electromagnetic contactor as claimed in claim 1 wherein said base has an opening in the bottom thereof and said rail means comprises a rail plate having rails thereon and said rail plate is disposed in said opening in the bottom of said base with said rails within said internal space.

4. An electromagnetic contactor as claimed in claim 3 wherein said rail plate has an engaging hole therein for being engaged by said latch mechanism.

5. An electromagnetic contactor as claimed in claim 1 wherein said cover has a space for accommodating said latch mechanism.

6. An electromagnetic contactor as claimed in claim 5 wherein said latch mechanism accommodating space includes an outward opening through which said latch mechanism can be operated.

7. An electromagnetic contactor as claimed in claim 1, said contactor further comprising circuit terminals for an electric circuit in which said contactor is to be connected and positioned on a lateral portion of said base and said lateral opening in said base being on the same side of said contactor as said lateral portion.

8. An electromagnetic contactor as claimed in claim 1 wherein said rail plate includes stop means against which said coil holder abuts after moving into said base a predetermined distance.

* * * * *